US010487549B2

(12) United States Patent
Fu

(10) Patent No.: US 10,487,549 B2
(45) Date of Patent: Nov. 26, 2019

(54) HINGE

(71) Applicant: Hai Fu, Guangdong (CN)

(72) Inventor: Hai Fu, Guangdong (CN)

( * ) Notice: Subject to any disclaimer, the term of this patent is extended or adjusted under 35 U.S.C. 154(b) by 160 days.

(21) Appl. No.: 15/444,344

(22) Filed: Feb. 28, 2017

(65) Prior Publication Data

US 2017/0167171 A1 Jun. 15, 2017

Related U.S. Application Data

(63) Continuation of application No. PCT/CN2015/077328, filed on Apr. 23, 2015.

(30) Foreign Application Priority Data

Sep. 1, 2014 (CN) ..... 2014 1 0439629

(51) Int. Cl.
*E05D 3/12* (2006.01)
*E05D 11/08* (2006.01)

(52) U.S. Cl.
CPC ..... *E05D 3/122* (2013.01); *E05D 11/087* (2013.01); *E05Y 2201/26* (2013.01); *E05Y 2900/132* (2013.01); *E05Y 2900/148* (2013.01)

(58) Field of Classification Search
CPC ..... E05D 3/122
See application file for complete search history.

(56) References Cited

U.S. PATENT DOCUMENTS 2,078,815 A * 4/1937 Segar ..... E05D 3/022 126/194
5,500,985 A * 3/1996 Klueger ..... E05D 3/022 16/354
5,788,330 A * 8/1998 Ryan ..... B60N 2/2354 297/367 R
6,134,751 A * 10/2000 Carrier ..... E05D 15/44 16/235

(Continued)

FOREIGN PATENT DOCUMENTS

CN 2536729 Y 2/2003
CN 201062469 Y 5/2008

(Continued)

OTHER PUBLICATIONS

International Search Report of PCT Patent Application No. PCT/CN2015/077328 dated Jun. 29, 2015.

(Continued)

*Primary Examiner* — Victor D Batson
*Assistant Examiner* — Matthew J Sullivan

(57) ABSTRACT

A hinge used for being installed between a door leaf and a door frame or between a sash and a window frame (7). The hinge includes a gear and rack unit and an inclined draw bar (1). The gear and rack unit is installed on the door frame or window frame (7). A gear (5) is rotatably installed on the door frame or window frame (7). A rack is located on one side of the gear (5). The gear (5) is meshed with the rack. A gear installation portion (51) is arranged on one side of the gear (5). Both ends of the inclined draw bar (1) are installed (Continued)

on the door leaf and door frame or the sash and window frame (7) respectively. According to the present invention, the problem that the existing hinge is unreasonably stressed and prone to damage is effectively solved.

13 Claims, 7 Drawing Sheets

(56) References Cited

U.S. PATENT DOCUMENTS

| | | | | |
|---|---|---|---|---|
| 6,520,557 | B2 * | 2/2003 | Benthaus | E05F 1/1091 296/107.08 |
| 7,257,864 | B2 * | 8/2007 | Liang | E05D 7/0415 16/239 |
| 7,926,370 | B2 * | 4/2011 | Kawabuchi | F16H 37/12 414/739 |
| 8,032,989 | B2 * | 10/2011 | Liang | E05D 7/0423 16/362 |
| 8,434,265 | B1 * | 5/2013 | Campbell | E05D 15/30 16/195 |
| 8,468,656 | B2 * | 6/2013 | Bauman | E05D 15/30 16/199 |
| 8,769,873 | B2 * | 7/2014 | Feng | E05C 17/28 49/246 |
| 10,081,974 | B2 * | 9/2018 | Gherardi | A47L 15/4265 |
| 2012/0217855 | A1 | 8/2012 | Chen et al. | |
| 2017/0152690 | A1 * | 6/2017 | Knoechel | E05D 3/022 |

FOREIGN PATENT DOCUMENTS

| | | | |
|---|---|---|---|
| DE | 10205009 | A1 | 8/2003 |
| GB | 2276915 | A | 10/1994 |
| TW | 242913 | | 3/1995 |
| TW | M317491 | | 8/2007 |
| WO | 9421879 | A1 | 9/1994 |

OTHER PUBLICATIONS

1st Office Action of counterpart Chinese Patent Application No. 201410439629.6 dated Nov. 24, 2015.

Search Report of European Patent Application No. 15837865.3 dated Mar. 12, 2018.

* cited by examiner

HINGE

CROSS REFERENCE TO RELATED APPLICATIONS

The present application is a Continuation Application of PCT application No. PCT/CN2015/077328 filed on Apr. 23, 2015, which claims the benefit of Chinese Patent Application No. 201410439629.6 filed on Sep. 1, 2014. All the above are hereby incorporated by reference.

TECHNICAL FIELD

The present invention belongs to the field of door or window hardware fittings, and in particular relates to a hinge.

BACKGROUND

A hinge is a more commonly used door or window hardware fitting, and is mainly used to install doors or windows above door frame or window frames. Of course, in practice, the hinge is generally used for installing windows, and is less used for installing doors.

The existing hinge generally comprises a plurality of connecting rods which are riveted with each other to form a four-rod or more-rod mechanism for installing the door or window and supporting the opening and closing of the door or window. A five-link window hinge in Patent No. 02225773.X is a common hinge available on the existing market. Although the structure of the hinge can achieve the above functions, the main weight of the door or window is transmitted to the connecting portion of a connecting rod 3 and a baffle 5. Since the connecting rod 3 and the baffle 5 are connected by means of a rivet, the main weight of the door or window is borne by the rivet. In practice, most of to the weight of the door or window is borne by the rivet, so that the connecting portion between the connecting rod 3 and the baffle 5 is easily damaged.

SUMMARY

It is an object of the present invention to provide a hinge, which aims at solving the problem that the existing hinge is unreasonably stressed and easily damaged.

The present invention is achieved by a hinge, which is used for being installed between a door leaf and a door frame or between a sash and a window frame, wherein the hinge comprises a gear and rack unit and an inclined draw bar, the gear and rack unit is installed on the door frame or window frame, wherein the gear is rotatably installed on the door frame or window frame, the rack is located on one side of the gear, the gear is meshed with the rack, a gear installation portion is arranged on one side of the gear, and both ends of the inclined draw bar are installed on the door leaf and door frame or the sash and window frame respectively.

After the above technical solution is used, the gear and rack unit can form a force arm outside the installation portion reducing the number of hinge parts. In addition to the fact that the weight of the door or window is partially borne by the gear installation portion, most of the gravity of the door or window can be counteracted by the force arm formed by the gear and rack unit, and therefore the weight of the door or window can be largely shared; in this manner, the stress structure of the hinge is more reasonable, and the problem that the existing hinge is unreasonably stressed and prone to damage is effectively solved.

The hinge comprises a gear installation shaft which is horizontally movably installed on the door frame or window frame, and the gear is installed on the gear installation shaft.

The hinge comprises a first support bar and a second support bar, the gear and rack unit is installed on the first support bar, one end of the second support bar is installed on the gear installation portion, both ends of the inclined draw bar are installed on the first support bar and the second support bar respectively, and the hinge is installed on the door leaf and door frame or the sash and window frame by means of the first support bar and the second support bar respectively.

The hinge comprises an installation shaft, the gear installation portion is connected with the second support bar by means of the installation shaft, the installation shaft is provided with a hinge, and the sash or door leaf is installed on the hinge.

A first support bar installation portion is arranged on the first support bar, a gear installation groove is arranged on the first support bar installation portion, the gear installation groove is a waist-shaped groove, and the gear installation shaft is installed in the gear installation groove.

One end of the inclined draw bar is installed on the second support bar by means of an axis of rotation, while the other end thereof is installed on the first support bar by means of an axis of rotation.

A bent portion is arranged on the gear installation portion, an installation groove is formed between the bent portion and the bottom of the gear installation portion, and one side of the first support bar is installed in the installation groove.

The gear and rack unit comprises a gear and a rack, the gear is a sector gear, and the rack is a perforation or a common rack.

The door frame or window frame is made of a profile which is provided with a profile groove, one side of the first support bar is provided with a flange, and the flange matches with the profile groove.

The friction block is located below the gear and is in contact with the gear.

DESCRIPTION OF THE EMBODIMENTS

Figure 1:
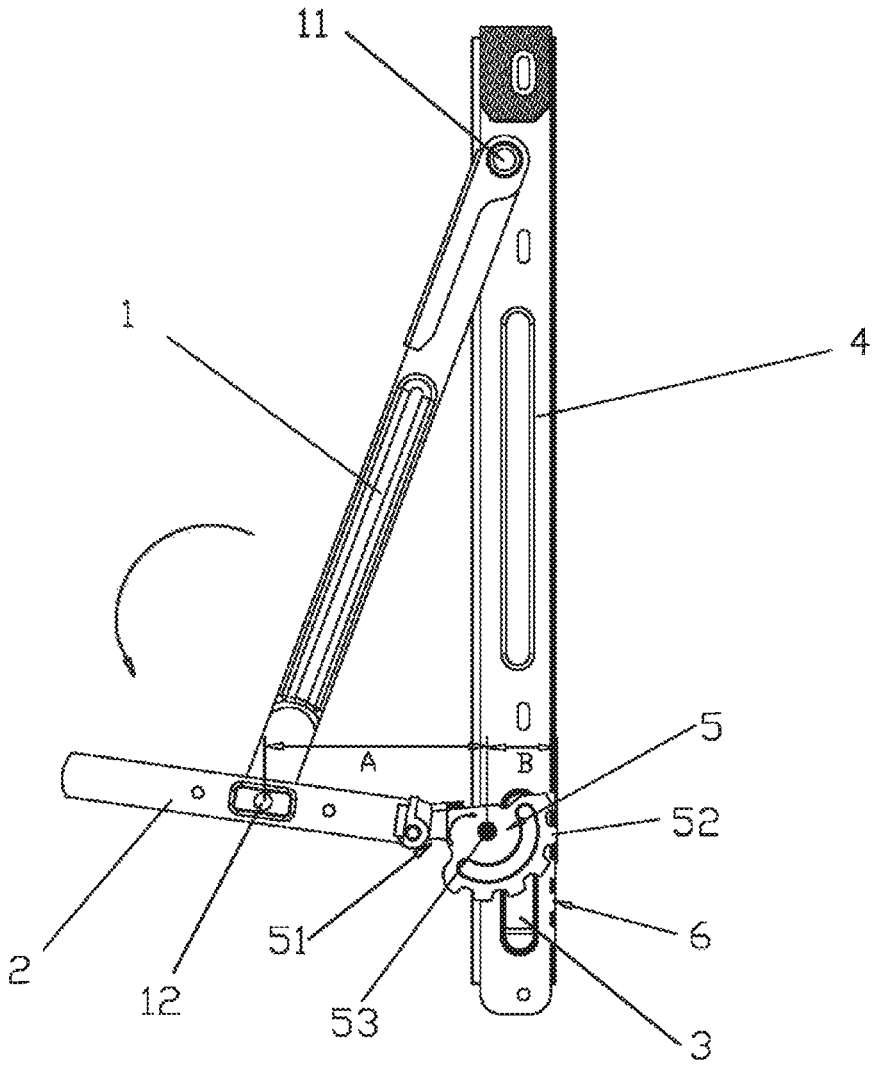
FIG. 1 is a cross-sectional schematic view of a hinge provided by an embodiment of the present invention.

In order that the objects, technical solutions and advantages of the present invention will become more apparent, the present invention will be described in further detail in conjunction with the accompanying drawings and embodiments. It should be understood that the embodiments described herein are only for the purpose of explaining the invention and are not intended to be limiting of the invention.

The present invention provides a hinge for being installed on a side-hung door or window. In practice, the hinge is mainly used on a side-hung window, and in the present specification, the hinge is installed on a side-hung window as an example. The technical solution and the technical effect that the hinge is installed on a side-hung door can refer to the embodiment on a side-hung window.

Referring to FIGS. 1-6, the side-hung window comprises a sash 8 and a window frame 7. The sash 8 and the window frame 7 are made of a profile. The hinge provided by the embodiment has a function of installing the sash 8 on the window frame 7 so that the sash 8 can be smoothly opened and closed on the window frame 7.

Referring to FIGS. 1-6, in the present embodiment, the hinge comprises a gear and rack unit and an inclined draw bar 1, the gear and rack unit is installed on the window frame 7, the gear and rack unit comprises a gear 5 and a rack, the gear 5 is a sector gear, and the gear 5 is installed on the window frame 7 by means of a gear installation shaft 53, the gear 5 is rotatable about the gear installation shaft 53, and the gear installation shaft 53 is horizontally movable on the window frame 7. It should be noted that in the present embodiment, the gear 5 may be installed directly on the window frame 7 or on the window frame 7 by means of other members. Installed on the gear installation portion 51, a plurality of rotation teeth 52 are arranged on the other end of the gear 5. The rack is a perforation 6 or a common rack (not shown in the figures), and the gear 5 is meshed with the rack. In the present embodiment, the rack is a perforation 6 which is formed by arranging a plurality of rectangular holes 61 at regular intervals. The perforation 6 is opened on one side of the gear 5, and the gear 5 is meshed with the perforation 6. Referring to FIGS. 1-7, both ends of the inclined draw bar 1 are actively installed on the door leaf 8 and door frame or the sash and window frame 7 respectively.

After the above technical solution is used, the gear and rack unit can achieve the smooth opening and closing of sash 8 on the window frame 7 on the premise that the number of hinge parts is reduced, and it is particularly important that the gear and rack unit can form a force arm outside the gear installation portion 51. Most of the downward gravity of the door or window can be counteracted by the force arm formed by the gear and rack unit, and therefore the weight of the door or window can be largely shared; in this manner, the stress structure of the hinge is more reasonable, and the problem that the existing hinge is unreasonably stressed and prone to damage is effectively solved.

As a preferred embodiment of the technical solution, the hinge comprises a first support bar 4 and a second support bar 2, and the gear and rack unit is installed on the first support bar 4. Referring to FIGS. 1-7, a first support bar installation portion 41 is arranged on the first support bar 4, the first support bar installation portion 41 is formed by a bending process, and the perforation 6 is opened at the side of the first support bar 4, and the gear 5 is installed below the first support bar installation portion 41. In the present embodiment, if the rack is a common rack, the rack is installed below the first support bar installation portion 41.

Specifically, a gear installation groove 42 is opened on the first support bar installation portion 41, the gear installation groove 42 is a waist-shaped groove, the gear installation shaft 53 is installed in the gear installation groove 42, the gear 5 is installed below the gear installation groove 42, and the gear installation shaft 53 installs the gear 5 on the gear installation groove 42 through a gear installation hole 50 provided in the gear 5.

After the above technical solution is used, when the gear 5 rotates about the gear installation shaft 53, the rotation tooth 52 on the gear 5 moves relative to the perforation 6. Since the position of the perforation 6 is relatively immovable, the gear installation shaft 53 and the gear 5 move within the length range of the gear installation groove 42.

Figure 2:
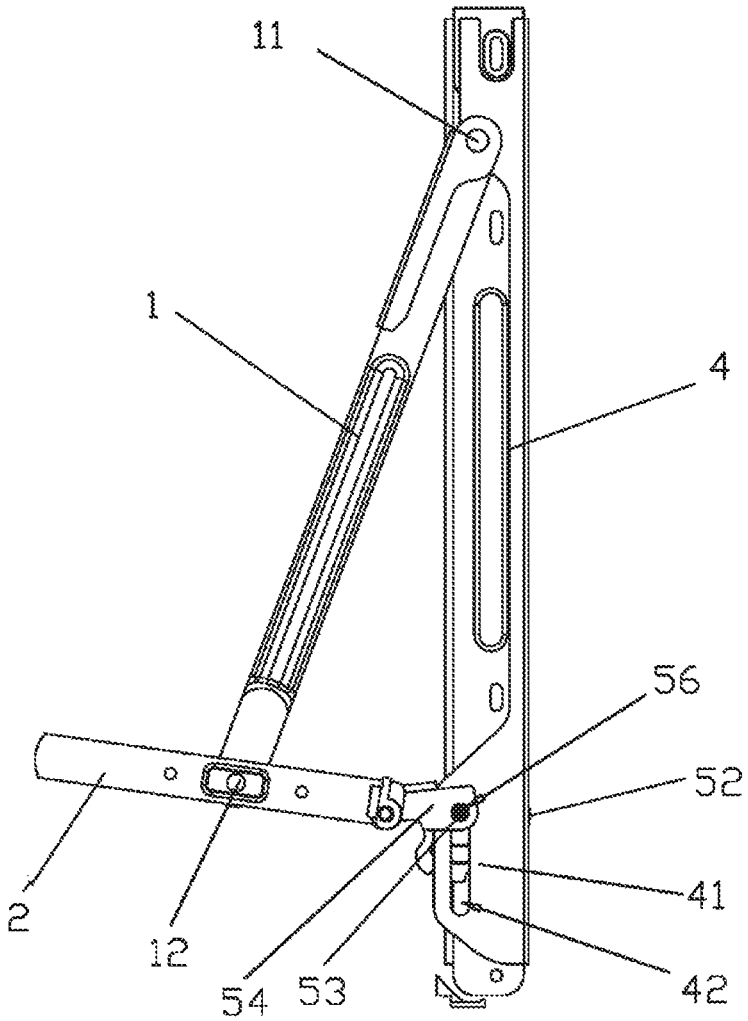
FIG. 2 is a front schematic view of a hinge provided by an embodiment of the present invention.
Figure 3:
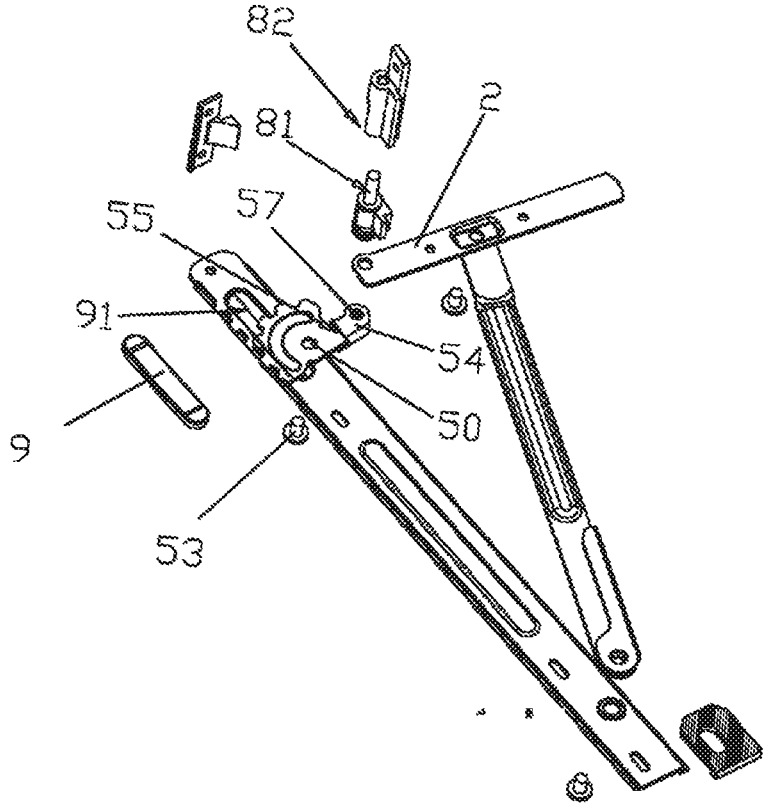
FIG. 3 is an exploded schematic view of a hinge provided by an embodiment of the present invention.

Referring to FIGS. 1-3, a bent portion 54 is arranged on the gear installation portion 51, an installation groove 55 is formed between the bent portion 54 and the bottom of the gear installation portion 51, and one side of the first support bar installation portion 41 is located in the installation groove 55, a circular hole 56 is opened respectively in the bent portion 54 and the bottom of the gear installation portion 5, and the circular hole 56 is an opposite perforation. The gear installation shaft 53 installs the gear 5 above the first support bar 4 through the circular hole 56, the gear installation hole 50, and the gear installation groove 42. After the above technical solution is used, since the first support bar installation portion 41 and the gear installation groove 42 are located in the installation groove 55 formed in the bending portion 54 and the bottom of the gear installation portion 51, the structure is more reasonable, and the overall strength of the hinge is greatly improved.

Referring to FIGS. 1 to 7, the hinge includes an installation shaft 81, the gear installation portion 51 is connected with the second support bar by means of the installation shaft 81, a hinge 82 is arranged on the installation shaft 81, the side of the sash 8 is installed on the hinge 82, and the window leaf 8 is rotatable about the installation shaft 81.

Referring to FIGS. 1 to 6, one end of the second support bar 2 is installed on a circular hole 57 opened in the gear installation portion 51 by means of the installation shaft 8, both ends of the inclined draw bar 1 are installed on the first support bar 4 and the second support bar 2 respectively, and the hinge is connected to the door frame or window frame and the sash or door leaf through the first support bar 4 and the second support bar 2, respectively. Specifically, one end of the inclined draw bar 1 is rotatably installed on the second support bar 2 by means of an axis of rotation 12, while the other end thereof is rotatably installed on the first support bar 4 by means of an axis of rotation 11. The inclined draw bar 1, the first support bar 4, the second support bar 2, and the gear 5 form a connecting rod mechanism.

Referring to FIGS. 1 to 7, an upper hinge and a lower hinge are usually installed for installing the door or window. The upper hinge (not shown in the figures) is generally installed at the top of the door or window, and the lower hinge is generally installed at the bottom of the door or window. In the hinge provided by the present embodiment, the first support bar 4 of the upper hinge is installed to the upper inner wall of the window frame 7 with screws, and the second support bar 2 is installed to the top of the sash 8 with screws. Similarly, the first support bar 4 of the lower hinge is installed to the lower inner wall of the window frame 7 with screws, and the second support bar 2 is installed to the bottom of the sash 8 with screws; the hinges 82 on the upper and lower hinges are installed to the side wall of the sash 8 respectively.

Figure 4:
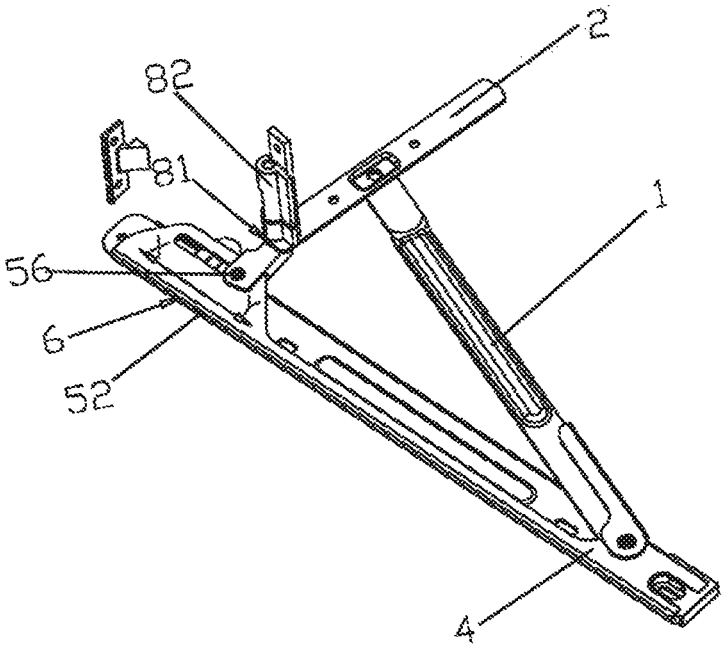
FIG. 4 is a perspective schematic view of a hinge provided by an embodiment of the present invention.

After the above technical solution is used, referring to FIGS. 1 and 4, by combining with other views, when the door or window need to be opened, the sash 8 is pushed outward, the sash 8 and the second support bar 2 are rotated counterclockwise around the installation shaft 81, and the second support bar 2 drives the gear 5 to be rotated clockwise through the gear installation portion 51. Since the gear 5 is meshed with the perforation 6, the gear installation shaft 53 and the gear 5 move in Y direction in the gear installation groove 42. When the gear installation shaft 53 moves to the top of the gear installation groove 42, the gear installation groove 42 prevents the gear installation shaft 53 and the gear 5 from moving, and the sash 8 is in the opening state at this time. Since the rotation tooth 52 on the gear 5 is located in the perforation 6, the stress structure of the door or window is more reasonable. Referring to FIG. 1, the stress structure of the door or window is as follows: taking the gear installation shaft 53 as the center, the sash 8 forms a downward acting moment with the arm of force A due to the effect of gravity, and the force acts on the gear installation shaft 53. Since the gear 5 is an integral structure, the gravity of the sash 8 is transmitted to the rotation tooth 52 by means of the gear 5. The connecting portion between the rotation tooth 52 and the perforation 6 generates an upward moment with the arm of force B. The downward moment and the upward moment form a lever structure with the result that most of the gravity of the sash 8 can be thereby counteracted by the connecting portion between the rotation tooth 52 and the perforation 6, and the gravity of the sash 8 can be borne by the gear installation shaft 53 and the connecting portion between the rotation tooth 52 and the perforation 6 respectively.

The structure of the hinge provided by the present embodiment can greatly disperse the gravity of the sash 8. The stress structure of the hinge is more reasonable than the gravity of the sash 8 on the existing hinge being directly borne by the connecting portion between the connecting rod 3 and the baffle 5, and the situation that the gravity generated by the existing sash or door leaf is directly borne by a rivet so that the rivet is prone to damage is effectively avoided.

Figure 5:
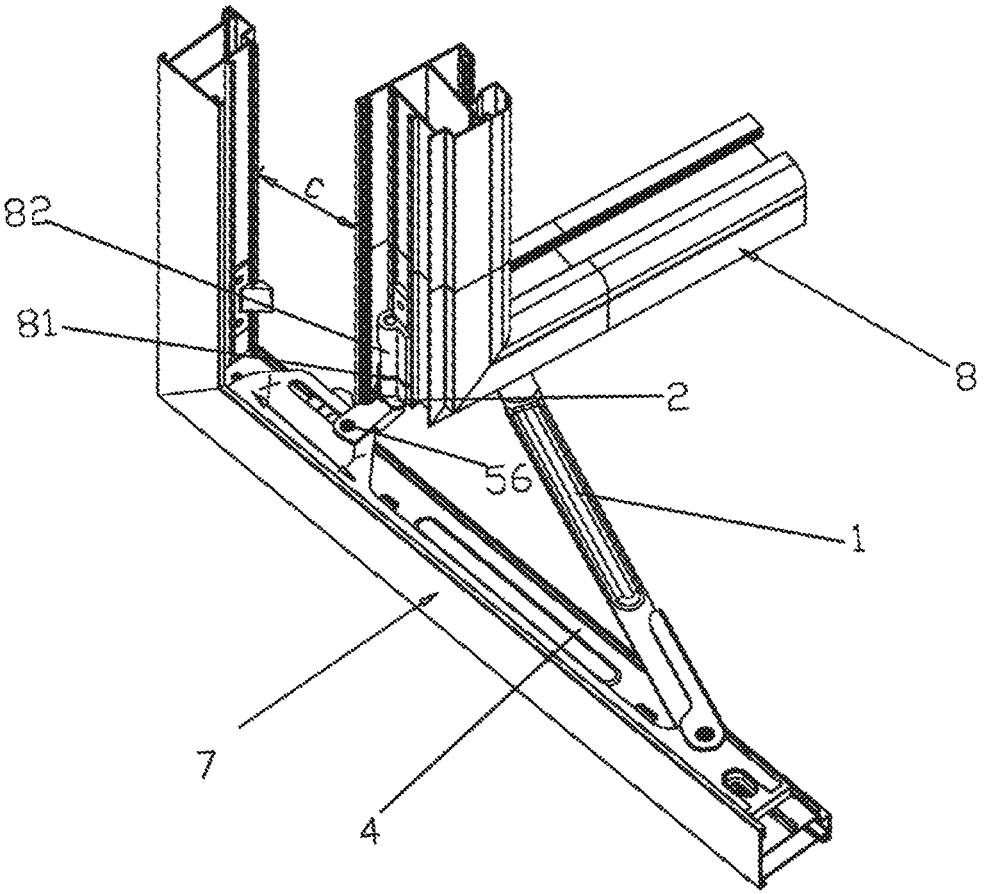
FIG. 5 is a perspective schematic view of a hinge installed on the door or window provided by an embodiment of the present invention.

Referring to FIG. 5, when the sash 8 is in the opening state, since the gear installation shaft 53 and the gear 5 move in the Y direction to the top of the gear installation groove 42, there is an interval C between the sash 8 and the side of the window frame 7. After the above technical solution is used, there are at least two technical effects: 1. both sides of the sash or door leaf can be ventilated, and the door or window have better ventilation than the common door or window; 2. the user can conveniently clean the side, facing out of the window, of the glass (not shown in the figure) installed on the sash or door leaf through the interval C, and the cleaning work of the sash or door leaf becomes very easy.

Figure 6:
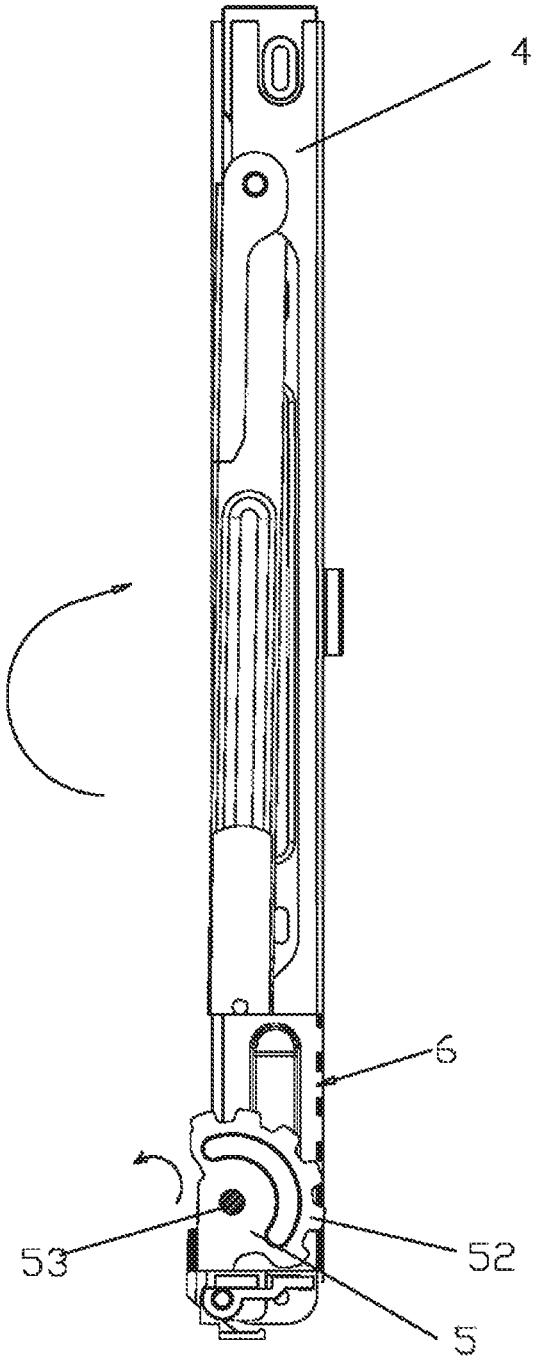
FIG. 6 is a partial cross-sectional schematic view of a hinge in the folding state provided by an embodiment of the present invention.
Figure 7:
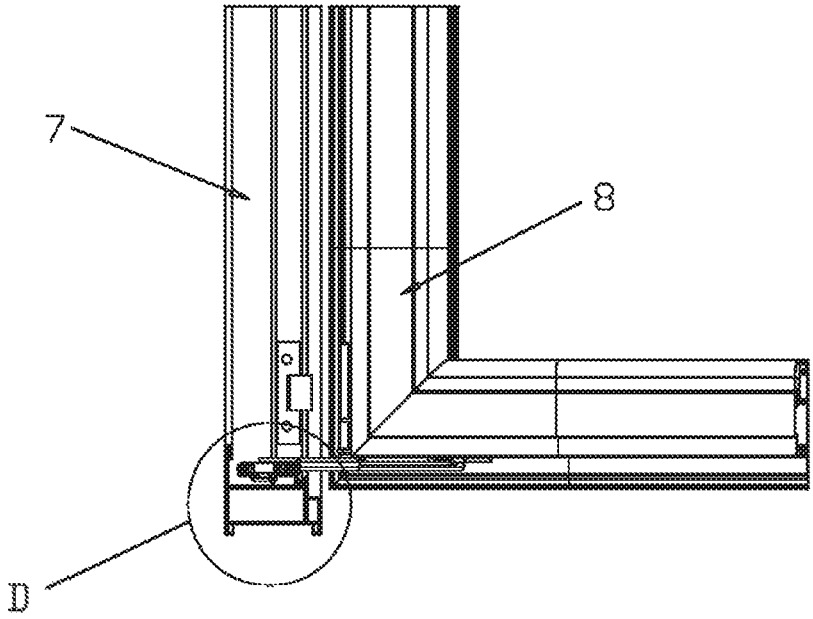
FIG. 7 is a cross-sectional schematic view of a hinge installed on the door or window provided by an embodiment of the present invention.

Referring to FIG. 6, by combining with referring to FIGS. 1-5, when it is desired to close the door or window, the sash 8 is pulled inwardly, the sash 8 and the second support bar 2 are rotated clockwise around the installation shaft 81, and the second support bar 2 drives the gear 5 to be rotated counterclockwise through the gear installation portion 51. Since the gear 5 is meshed with the perforation 6, the gear installation shaft 53 and the gear 5 move in X direction in the gear installation groove 42. When the second support bar 2 moves to the position where the second support bar 2 and the first support bar 4 are substantially parallel to each other, the door or window are in a closed state. At this time, the inclined draw bar 1 also moves to the position where the inclined draw bar 1 and the first support bar 4 are parallel to each other, the gear installation shaft 53 moves to the top of the gear installation groove 42 in the X direction, and the sash 8 and the window frame 7 are completely closed.

It is to be noted that the basic function of the above embodiment can also be realized if the hinge does not have the first support bar 4 and the second support bar 2. In this case, the gear and rack unit needs to be installed directly to the window frame 7. The sash 8 is rotatably installed on the gear installation portion 51, and both ends of the inclined draw bar 1 also need to be directly installed to the door leaf 8 and door frame or the sash and window frame 7. Since it is necessary in this case for the technician to align the installing position of the gear and rack and the inclined draw bar 1 on the window frame 7 and the sash 8, more installation time is needed.

Referring to FIGS. 1 to 7, the hinge further includes a friction block 9, a friction block installation groove 91 is arranged on the first support bar, the friction block installation groove 91 is located below the gear 5, the friction block 9 is installed within the friction block installation groove 91, the friction block 9 is made of material capable of generating a large frictional force, the friction block 9 is located below the gear 5, the friction block 9 is in contact with the gear 5, and a certain frictional force can thereby be generated between the friction block 6 and the gear 5. After the above technical solution is used, when the sash 8 is in the opening state and if the sash 8 is blown to the closed state by the wind at a common wind speed, the frictional force between the friction block 6 and the gear 5 can overcome the influence of the wind force so that the sash 8 remains in the opening state; when the sash 8 is blown to the closed state by the wind at a high wind speed, the frictional force between the friction block 6 and the gear 5 can overcome the influence of the wind force so that the sash 8 is closed slowly, preventing the sash 8 from quickly beating the window frame 7 so as to damage the door or window.

Figure 8:
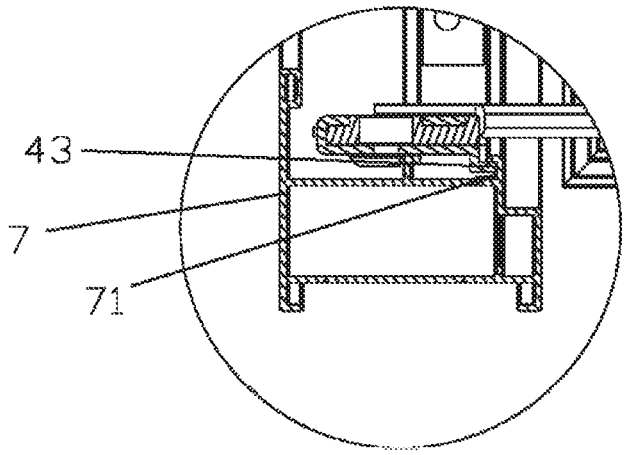
FIG. 8 is an enlarged schematic view of the portion D.

Referring to FIG. 8, the window frame 7 is made of a profile which is provided with a profile groove 71, a flange 43 is arranged on one side of the first support bar 4, and the flange 43 matches with the profile groove 71. When the first support bar 4 is installed on the window frame 7 by screws, the flange 43 is located within the profile groove 71, and the first support bar 4 is combined with the window frame 7 more firmly.

The above description is only for the purpose of describing preferred embodiments of the present invention and is not intended to be limiting of the present invention. Any modifications, equivalent substitutions and improvements made within the spirit and principle of the present invention should be included in the scope of protection of the present invention.

What is claimed is:

1. A hinge, comprising:

a first support bar having opposite first and second ends;

an inclined draw bar having opposite first and second ends, wherein the first end of the inclined draw bar is rotatably connected with the second end of the first support bar at a fixed point;

a second support bar rotatably connected with the second end of the inclined draw bar; and a gear and rack unit comprising a rack fixed to the first end of the first support bar and a gear having a plurality of teeth meshed with the rack, wherein the gear is a sector gear having a gear installation portion arranged on one side thereof and the plurality of teeth arranged on another side thereof, an end of the gear installation portion opposite to the plurality of teeth is rotatably connected with one end of the second support bar;

wherein the second support bar is rotatable relative to the first support bar between a closed position with a first included angle formed therebetween and an open position with a second included angle formed therebetween, and wherein the first included angle is smaller than the second angle; and wherein when the second support bar rotates between the closed position and the open position, the gear is driven by the second support bar to rotate and move along a longitudinal direction of the rack, and a first distance between the end of the gear installation portion and the second end of the first support bar in the closed position is greater than a second distance between the end of the gear installation portion and the second end of the first support bar in the open position.

2. The hinge according to claim 1, wherein the hinge comprises a gear installation shaft which is horizontally movably mounted on the first support bar, and the gear is mounted around the gear installation shaft.

3. The hinge according to claim 1, wherein the first support bar is a door frame or a window frame.

4. The hinge according to claim 1, wherein the hinge comprises a mounting shaft by means of which the end of the gear installation portion is rotatably connected with the end of the second support bar, and an auxiliary hinge rotatably mounted around the mounting shaft.

5. The hinge according to claim 2, wherein a first support bar installation portion is provided on the first support bar, the first support bar installation portion has a gear installation groove axially extending therethrough, and the gear installation shaft is engaged in the gear installation groove and movable in the gear installation groove under rotation of the second support bar.

6. The hinge according to claim 1, further comprising a first rotating shaft by means of which the first end of the inclined draw bar is rotatably connected with the first support bar, and a second rotating shaft by means of which the second end of the inclined draw bar is rotatably connected with the second support bar.

7. The hinge according to claim 5, further comprising a bent portion fixed to and arranged above the gear installation portion, with a mounting groove formed therebetween, wherein one side of the first support bar installation portion is received in the mounting groove.

8. The hinge according to claim 1, wherein the rack is a perforation or a common rack.

9. The hinge according to claim 1, wherein one side of the first support bar is provided with a flange, and the flange is engagable with a profile groove which is provided on a door frame or window frame.

10. The hinge according to claim 1, wherein the hinge comprises a friction block, which is located below the gear and is in contact with the gear, and is stationary when the gear moves along the longitudinal direction of the rack.

11. The hinge according to claim 7, wherein one end of the gear installation shaft is connected with the bent portion, an another end of the gear installation shaft extends through the gear installation groove and is connected with the gear.

12. The hinge according to claim 1, wherein the second support bar is a door leaf or a sash.

13. The hinge according to claim 2, wherein the plurality of teeth and the gear installation portion are integrally connected in a same plane and opposite to each other about the gear installation shaft.

* * * * *